US005151012A

United States Patent [19]

Hough

[11] Patent Number: 5,151,012

[45] Date of Patent: Sep. 29, 1992

[54] LIQUID COOLED AEROFOIL BLADE

[75] Inventor: Geoffrey S. Hough, Littleover, England

[73] Assignee: Rolls-Royce plc, London, England

[21] Appl. No.: 347,986

[22] Filed: Feb. 2, 1982

[30] Foreign Application Priority Data

Mar. 20, 1981 [GB] United Kingdom ..... 8108753

[51] Int. Cl.[5] ..... B63H 1/14

[52] U.S. Cl. ..... 416/95; 416/96 R

[58] Field of Search ..... 415/114, 115, 116, 175, 415/177; 416/95, 96 R, 96 A, 97 R, 97 A

[56] References Cited

U.S. PATENT DOCUMENTS

| | | | |
|---|---|---|---|
| 2,782,000 | 2/1957 | Ledinegg | 416/96 R |
| 3,738,771 | 6/1973 | Delarbre et al. | 415/114 |
| 4,190,398 | 2/1980 | Corsmeier et al. | 416/96 A |
| 4,302,153 | 11/1981 | Tubbs | 416/96 R |

*Primary Examiner*—Michael J. Garone

*Attorney, Agent, or Firm*—Cushman, Darby & Cushman

[57] ABSTRACT

A cooled rotor aerofoil blade having a closed cycle cooling system containing sodium comprises an aerofoil cross-section portion and a root portion which are interconnected by a shank portion. The shank portion encloses two pairs of chambers one chamber of each pair being interconnected with the other chamber by a heat exchanger provided on the upstream face of the shank portion. The aerofoil cross-section portion encloses a plurality of length-wise extending passages which interconnect the two pairs of chambers within the shank portion with a further chamber provided within the tip of the aerofoil cross-section portion. A closed cycle cooling system is thus defined which contains sodium as the cooling medium.

In operation, sodium contained within the passages of the aerofoil portion is vaporized, passes down the passage into the chambers and thence into the heat exchanger where it condenses. The condensed sodium is then centrifugally pumped into the shank chambers and back into the passages of the aerofoil portion. Thus the aerofoil portion is cooled, the waste heat being disposed of by way of the heat exchanger.

6 Claims, 2 Drawing Sheets

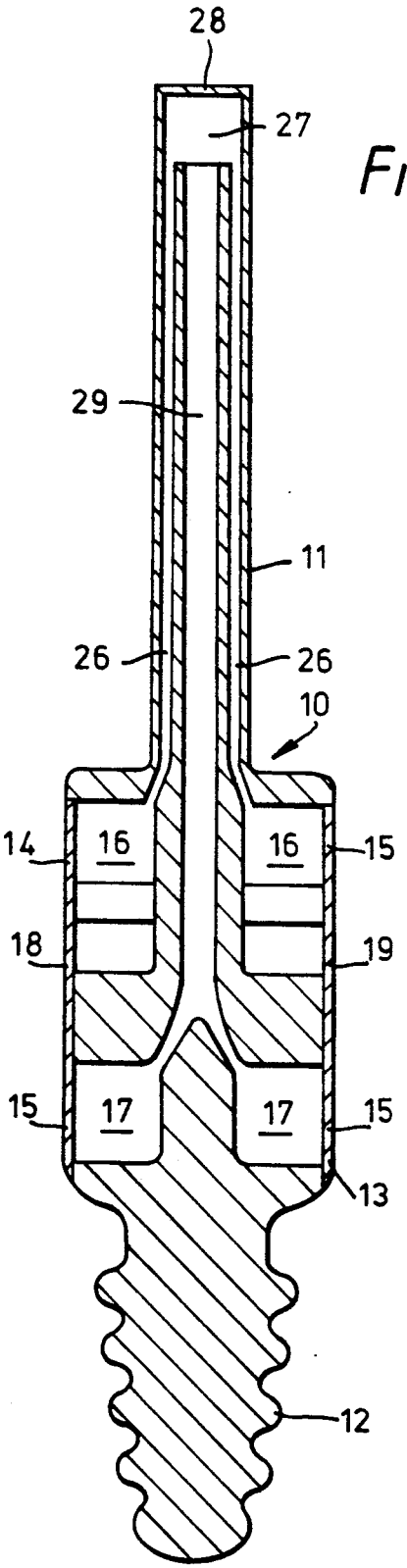
Fig. 2.
Fig. 4.
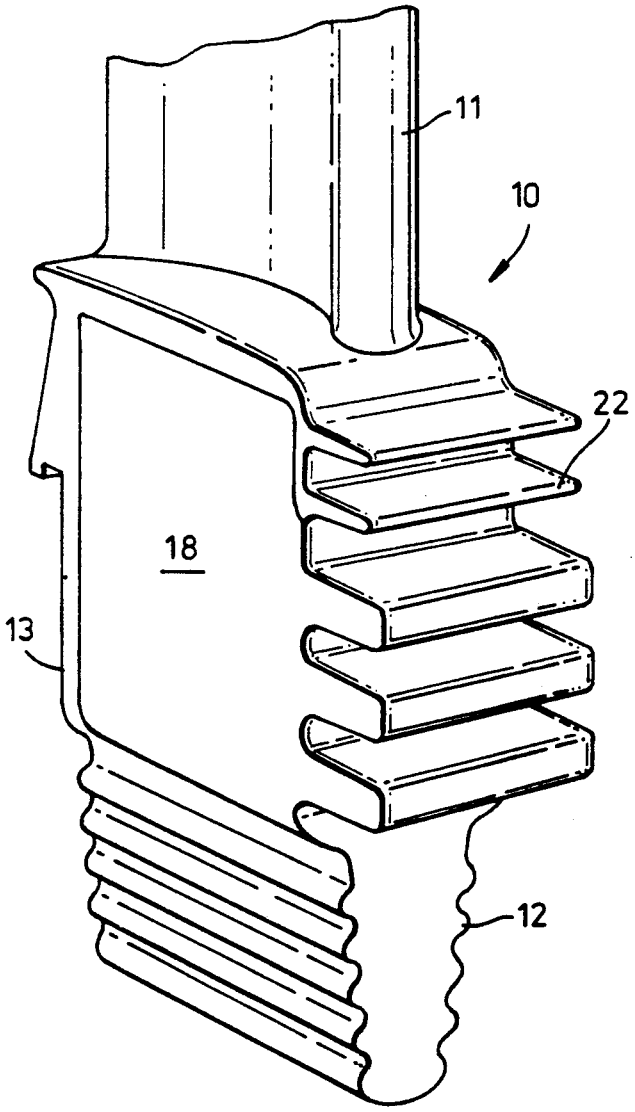

LIQUID COOLED AEROFOIL BLADE

This invention relates to cooled aerofoil blades and in particular to aerofoil blades employing a closed cycle liquid cooling system.

It is well known to provide aerofoil blades with closed cycle cooling system. This usually takes the form of one or more chambers within the blade which extend between the aerofoil portion of the blade and some other blade portion, usually the root or shank portion, which is in operation cooler than the aerofoil portion. The one or more chambers are sealed and contain an appropriate material, such as sodium, which is in its liquid state at root or shank temperatures and in its vapour state at aerofoil temperatures. In operation liquid sodium contained in the cool root or shank portion is centrifugally urged by the rotation of the aerofoil blade into the relatively hotter aerofoil portion of the blade where it vapourises. The sodium vapour then travels back to the root or shank portion as a result of the vapour pressure gradient within the chamber where it subsequently condenses. The cycle is continuously repeated, thereby transferring heat from the aerofoil portion of the blade to its root or shank portion.

In order that such liquid cooled aerofoil blades function as efficiently as possible, it is important that the condensation region of the blade is in effective heat exchanger relationship with a suitable external cooling fluid such as air. However it is very difficult to achieve this end in view of the problems associated with bringing the cooling liquid and cooling air into close proximity with each other.

It is an object of the present invention to provide a liquid cooled aerofoil blade having an improved heat exchange portion thereof, which heat exchange portion is adapted to provide enhanced heat exchange between the cooling liquid of said aerofoil blade and a suitable flow of cooling air.

According to the present invention, a cooled aerofoil blade having a closed cycle cooling system comprises an aerofoil cross-section portion, a root portion for the attachment of said aerofoil blade to the periphery of a rotary disc, and a shank portion interconnecting said aerofoil portion and said root portion, said closed cycle cooling system comprising at least one pair of chambers enclosed within said shank portion and disposed such that one chamber is situated closer to said root portion than the other chamber, said shank chambers being interconnected via a heat exchanger, and a plurality of passages provided within said aerofoil portion extending generally lengthwise thereof and terminating in a chamber defined within the tip of said aerofoil portion, at least one of said passages being located in the central region of said aerofoil portion and interconnecting said tip chamber with said shank chamber which is closer to said root portion, the remainder of said passages being located adjacent the external surface of said aerofoil portion and interconnecting said tip chamber with the other shank chamber, said closed cycle cooling system containing a liquid which is vapourised at the temperatures at which said aerofoil portion is adapted to operate and condensed at the temperatures at which said heat exchanger is adapted to operate.

Said heat exchanger is preferably situated on an external face of said shank portion which external face is adapted in operation to be cooled by a flow of cooling air.

Said heat exchanger may comprise a plurality of fins on said external face of said shank portion having a sinuous passage therethrough, each of said fins being adapted to put said cooling liquid in the portion of the passage therein in heat exchange relationship with said flow of cooling air.

Said fins on said heat exchanger are preferably adapted in operation to cooperate with corresponding fins on an adjacent stator member so that the two sets of fins are interdigitated to define a sinuous passage through which in operation said cooling air flows.

Said heat exchanger defined by the plurality of fins on the external face of the shank portion and by the sinuous passage therethrough, is preferably so arranged that the flow direction of the cooling liquid passing in operation therethrough is generally opposite to that of said cooling air passing in operation through said defined sinuous passage.

Said shank portion may be provided with two similar pairs of said chambers with one chamber of each pair disposed closer to said root portion than the remaining chambers, said tip chamber being in direct communication with said two shank chambers which are closer to said root portion via said at least one passage located in the central region of said aerofoil portion, said remaining two shank chambers being in direct communication with said tip chamber via said remaining passages in said aerofoil portion, said shank chambers which are disposed closer to said root portions being interconnected with said remaining shank chambers via said heat exchanger. Said cooling liquid is preferably sodium.

The invention will now be described, by way of example, with reference to the accompanying drawings in which:

FIG. 2 is a view on line A—A of FIG. 1.

FIG. 4 is a perspective view of part of the cooled aerofoil blade shown in FIG. 1.

Figure 1:
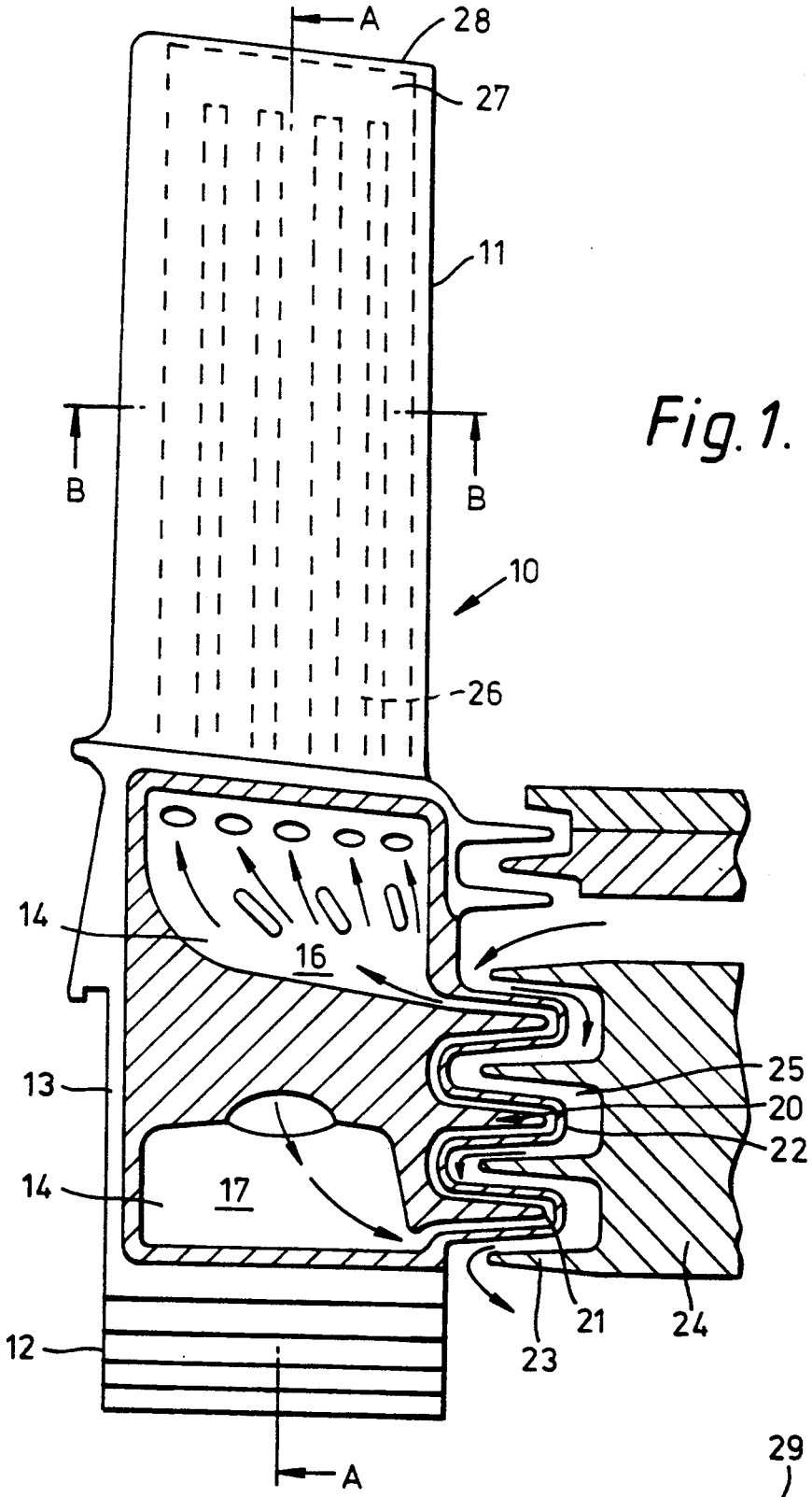
FIG. 1 is a side view of a cooled aerofoil blade in accordance with the present invention, a portion thereof having been omitted to reveal part of its internal structure.
Figure 3:
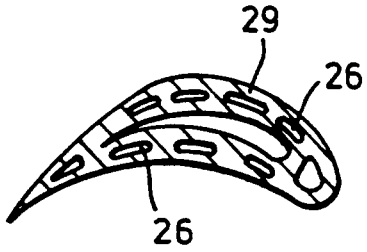
FIG. 3 is a view on line B—B of FIG. 1.

With reference to FIG. 1 an aerofoil blade 10 which is suitable for use in the turbine of a gas turbine engine, comprises an aerofoil cross-section portion 11, a root portion 12 and a shank portion 13 interconnecting the aerofoil and root portions 11,12. The root portion 12 is of the conventional "fir-tree" configuration to enable its location in a correspondingly shaped feature on the periphery of a rotary disc (not shown).

The shank portion 13 encloses two similar pairs of chambers 14 and 15 as can be seen in FIG. 2. The chamber pairs 14 and 15 are symmetrically disposed within the shank portion 13 so that one chamber 16 of each pair is located adjacent the aerofoil portion 11 and the other chamber 17 of each pair is located adjacent the root portion 12. The aerofoil blade 10 is a cast structure and consequently in order to facilitate its manufacture, the chambers 16 and 17 are defined by the basic cast structure of the blade 10 and side plates 18 and 19 which are brazed on to opposite sides of the shank portion 13. The side plate 18 has been omitted from the view shown in FIG. 1 in order to reveal details of the internal structure of the shank portion 13.

The chambers 16 and 17 are interconnected via a heat exchanger 20 which is provided on the upstream face of the shank portion 13. The heat exchanger 20 is a finned structure defined by a plurality of fins 22 having a sinuous common passage 21 extending therethrough and being operatively connected to the chambers 16 and 17. The fins 22 of the heat exchanger 20 are adapted so that when the aerofoil blade 10 is located within a turbine, the heat exchanger fins 22 cooperate with similar fins 23 provided on an adjacent stator member 24 so that the two sets of fins 22, 23 are interdigitated to define a sinuous passage 25. In operation, cooling air is directed through the sinuous passage 25 in the direction indicated by the arrows.

The aerofoil portion 11 has a plurality of passages 26 extending generally lengthwise thereof and located adjacent its external surface. The passages 26 interconnect the chambers 16 and a chamber 27 defined within the tip 28 of the aerofoil portion 11. The tip chamber 27 is also interconnected with the chambers 17 adjacent the root portion 12 by a single passage 29 which extends through the central region of the aerofoil portion 11 and is bifurcated in the shank portion 13 so as to communicate with both of the chambers 17.

The chambers 16, 17, passages 26,29, tip chamber 27 and heat exchanger 20 constitute a sealed system which is partially filled with sodium. In operation, hot gases passing over the aerofoil portion 11 heat up sodium contained within the passages 26 adjacent the external surface of the aerofoil portion 11. The sodium vapourises and passes into the tip chamber 27 and thence, as a result of vapour pressure gradients, down the passage 29 and into the chambers 17. It then passes into the heat exchanger 20 where the flow of cooling air over the fins 22 reduces the temperature of the sodium, thereby resulting in its condensation. The resultant liquid sodium is then centrifugally pumped, as a result of the rotary motion of the aerofoil blade 10 and its associated disc, so that the liquid sodium passes into the passages 26 and the cycle is repeated. A closed cycle cooling system is thus defined in which heat is transferred from the aerofoil portion 11 to the heat exchanger 20 and thence to the cooling air passing through the sinuous passage.

It will be noted that the direction of flow of liquid sodium through the heat exchanger 20 is generally opposite to the direction of flow of cooling air through the sinuous passage 25. This ensures effective heat transfer between the liquid sodium and the cooling air.

Although the present invention has been described with reference to an aerofoil blade 10 having two pairs of chambers 14 and 15 in its shank portion 13, there could in fact be only one pair. In such an arrangement, the positioning of the passages 26 and 29 within the shank portion 13 would, of course, have to be suitably altered.

I claim:

1. A cooled aerofoil blade having a closed cycle cooling system comprising an aerofoil cross-section portion, a root portion for the attachment of said aerofoil blade to the periphery of a rotary disc, and a shank portion interconnecting said aerofoil portion and said root portion, said closed cycle cooling system comprising at least one pair of chambers enclosed within said shank portion and disposed so that one chamber is situated closer to said root portion than the other chamber, a heat exchanger for condensing a vapourised liquid passing therethrough, said heat exchanger being positioned on an external face of said shank portion and arranged in operation to be cooled by a flow of cooling air, said heat exchanger operatively interconnecting said at least one pair of chambers, and a plurality of passages provided within said aerofoil portion extending generally lengthwise thereof and terminating in a chamber defined within the tip of said aerofoil portion, at least one of said passages being located in the central region of said aerofoil portion and interconnecting said tip chamber with said shank chamber which is closer to said root portion, the remainder of said passages being located adjacent the external surface of said aerofoil portion and interconnecting said tip chamber with the other shank chamber, said closed cycle cooling system containing a liquid which is vapourised at the temperatures at which said aerofoil portion is adapted to operate and condensed at the temperatures at which said heat exchange is adapted to operate.

2. A cooled aerofoil blade as claimed in claim 1 wherein said heat exchanger comprises a plurality of fins having a sinuous passage therethrough for the vapourised liquid, said fins being on said external face of said shank portion, each of said fins being adapted to put the vapourised liquid in heat exchange relationship with said flow of cooling air.

3. A cooled aerofoil blade as claimed in claim 2 wherein said fins on said heat exchanger are adapted in operation to cooperate with corresponding fins on an adjacent stator member so that the two sets of fins are interdigitated to define a sinuous passage through which in operation said cooling air flows.

4. A cooled aerofoil blade as claimed in claim 3 wherein said heat exchanger is so arranged that the flow direction of the vapourised liquid passing in operation therethrough is generally opposite to that of said cooling air passing in operation through said defined sinuous passage.

5. A cooled aerofoil blade as claimed in claim 1 wherein said shank portion is provided with two similar pairs of said chambers, with one chamber of each pair disposed closer to said root portion than the remaining chambers, said tip chamber being in direct communication with said two shank chambers which are closer to said root portion by said at least one passage located in the central region of said aerofoil portion, said remaining two shank chambers being in direct communication with said tip chamber by said remaining passages in said aerofoil portion, said shank chambers which are disposed closer to said root portion being interconnected with said remaining shank chambers by said heat exchanger.

6. A cooled aerofoil blade as claimed in any one preceding claim wherein said cooling liquid is sodium.

* * * * *